US011762323B2

(12) United States Patent
Sato

(10) Patent No.: US 11,762,323 B2
(45) Date of Patent: Sep. 19, 2023

(54) IMAGE FORMING APPARATUS

(71) Applicant: BROTHER KOGYO KABUSHIKI KAISHA, Nagoya (JP)

(72) Inventor: Shougo Sato, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/857,009

(22) Filed: Jul. 3, 2022

(65) Prior Publication Data

US 2022/0334531 A1 Oct. 20, 2022

Related U.S. Application Data

(63) Continuation of application No. 17/114,120, filed on Dec. 7, 2020, now Pat. No. 11,409,222, which is a (Continued)

(30) Foreign Application Priority Data

May 24, 2018 (JP) ..... 2018-099445

(51) Int. Cl.
*G03G 21/00* (2006.01)
*G03G 21/10* (2006.01)
*G03G 21/12* (2006.01)

(52) U.S. Cl.
CPC ..... *G03G 21/105* (2013.01); *G03G 21/12* (2013.01)

(58) Field of Classification Search
CPC .. G03G 21/105; G03G 21/12; G03G 21/1647; G03G 21/169; G03G 21/18
See application file for complete search history.

(56) References Cited

U.S. PATENT DOCUMENTS 5,398,098 A 3/1995 Fukunaga et al.
5,809,376 A 9/1998 Chiesa et al.
(Continued)

FOREIGN PATENT DOCUMENTS

JP 2015-036765 A 2/2015
JP 2015-175936 A 10/2015
(Continued)

OTHER PUBLICATIONS

Japanese Office Action (Decision to Refusal) for the related Japanese Patent Application No. 2018-099445 dated Mar. 29, 2022.

*Primary Examiner* — Hoang X Ngo
(74) *Attorney, Agent, or Firm* — Kenealy Vaidya LLP

(57) ABSTRACT

An image forming apparatus includes an apparatus main body, a drawer, a drum cartridge, an exposure device, a developing cartridge, and a fixing device. The drum cartridge includes a photosensitive drum, a cleaning member, and a waste toner conveying pipe. The drum cartridge is mountable to the drawer. The developing cartridge includes a toner container and a waste toner container, and is attachable to and detachable from the drum cartridge. The toner container includes a developing roller. The cleaning member is located between the photosensitive drum and the fixing device in a vertical direction in a state where the drum cartridge is mounted to the drawer and the drawer is located at an inner position. The toner container is swingably coupled to the waste toner container, thereby being capable of moving relative to the photosensitive drum in a state where the developing cartridge is attached to the drum cartridge.

15 Claims, 12 Drawing Sheets

Related U.S. Application Data continuation of application No. 16/421,440, filed on May 23, 2019, now Pat. No. 10,859,964.

(56) References Cited

U.S. PATENT DOCUMENTS

| | | | | |
|---|---|---|---|---|
| 5,881,341 | A | 3/1999 | Kumar et al. | |
| 7,840,171 | B2 | 11/2010 | Kim et al. | |
| 2011/0176817 | A1 | 7/2011 | Kim et al. | |
| 2015/0050044 | A1* | 2/2015 | Sato | G03G 21/105 399/358 |
| 2015/0147090 | A1 | 5/2015 | Sato et al. | |
| 2015/0192890 | A1 | 7/2015 | Kikuchi et al. | |
| 2015/0261173 | A1 | 9/2015 | Sato | |
| 2015/0355595 | A1 | 12/2015 | Jang et al. | |
| 2016/0103418 | A1 | 4/2016 | Yada et al. | |
| 2016/0139558 | A1 | 5/2016 | Kawakami et al. | |
| 2016/0154373 | A1 | 6/2016 | Numata et al. | |
| 2016/0154374 | A1 | 6/2016 | Hiramatsu et al. | |
| 2016/0154375 | A1 | 6/2016 | Kamizato et al. | |
| 2017/0102641 | A1 | 4/2017 | Sato | |
| 2017/0285568 | A1 | 10/2017 | Nishiyama et al. | |
| 2017/0355192 | A1* | 12/2017 | Makiguchi | B41J 2/17556 |

FOREIGN PATENT DOCUMENTS

| | | | |
|---|---|---|---|
| JP | 2016-81034 | A | 5/2016 |
| JP | 2016-99403 | A | 5/2016 |
| JP | 2016-102986 | A | 6/2016 |
| JP | 2016-102987 | A | 6/2016 |
| JP | 2016-110104 | A | 6/2016 |
| JP | 2016-110133 | A | 6/2016 |
| JP | 2017-72704 | A | 4/2017 |
| JP | 2017-161614 | A | 9/2017 |
| JP | 2017-182011 | A | 10/2017 |
| JP | 2017-223805 | A | 12/2017 |

* cited by examiner

IMAGE FORMING APPARATUS

CROSS-REFERENCE TO RELATED APPLICATIONS

This application is a continuation application claiming priority benefit under 35 U.S.C. 120 of U.S. patent application Ser. No. 17/114,120 filed on Dec. 7, 2020 which in turn is a continuation application priority benefit under 35 U.S.C. 120 of U.S. patent application Ser. No. 16/421,440 filed on May 23, 2019 which issued as U.S. Pat. No. 10,859,964 on Dec. 8, 2020, and is based upon and claims the benefit of priority under 35 U.S.C. 119 to Japanese patent application No. 2018-099445, filed on May 24, 2018, the entire contents of all of which are incorporated herein by reference.

TECHNICAL FIELD

The present disclosure relates to an image forming apparatus.

BACKGROUND

In related art, an image forming apparatus includes an apparatus main body, a drawer moveable between an inner position located inside the apparatus main body and an outer position located outside the apparatus main body, a cartridge mountable to the drawer, an exposure device, and a fixing device. The cartridge includes a photosensitive drum, a cleaning member configured to remove waste toner from the photosensitive drum, and a developing unit including a developing roller and configured to accommodate therein toner. In a state where the cartridge is mounted to the drawer and the drawer is located at the inner position, the cleaning member is located between the photosensitive drum and the fixing device.

In the above-described image forming apparatus, the cartridge integrally includes the photosensitive drum and the developing unit.

For this reason, for example, when a remaining amount of toner in the developing unit is reduced, the entire cartridge including the photosensitive drum needs be replaced even when it is not necessary to replace the photosensitive drum. As a result, it is difficult to save cost.

SUMMARY

Aspect of non-limiting embodiments of the present disclosure relates to provide an image forming apparatus in which a cleaning member is located between a photosensitive drum and a fixing device in a vertical direction in a state where a drum cartridge is mounted to a drawer and the drawer is located at an inner position and a drum cartridge and a developing cartridge can be individually replaced.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the disclosure, there is provided an image forming apparatus including: an apparatus main body; a drawer moveable between an inner position located inside the apparatus main body and an outer position located outside the apparatus main body; a drum cartridge mountable to the drawer and including: a photosensitive drum; a cleaning member configured to remove waste toner from the photosensitive drum; and a waste toner conveying pipe configured to convey the waste toner removed from the photosensitive drum by the cleaning member; an exposure device configured to expose the photosensitive drum to form a latent image on a peripheral surface of the photosensitive drum; a developing cartridge attachable to and detachable from the drum cartridge and including: a toner container including a developing roller configured to form a toner image by developing the latent image formed on the photosensitive drum by toner, the toner container being capable of accommodating therein toner to be supplied to the developing roller; and a waste toner container capable of accommodating therein the waste toner; and a fixing device configured to fix the toner image transferred from the photosensitive drum to a printing medium and being spaced upward from the photosensitive drum in a state where the drum cartridge is mounted to the drawer and the drawer is located at the inner position, wherein the cleaning member is located between the photosensitive drum and the fixing device in a vertical direction in the state where the drum cartridge is mounted to the drawer and the drawer is located at the inner position, and wherein the toner container is swingably coupled to the waste toner container, and thereby the toner container is movable relative to the photosensitive drum in a state where the developing cartridge is attached to the drum cartridge.

DETAILED DESCRIPTION

1. Outline of Image Forming Apparatus

Figure 1:
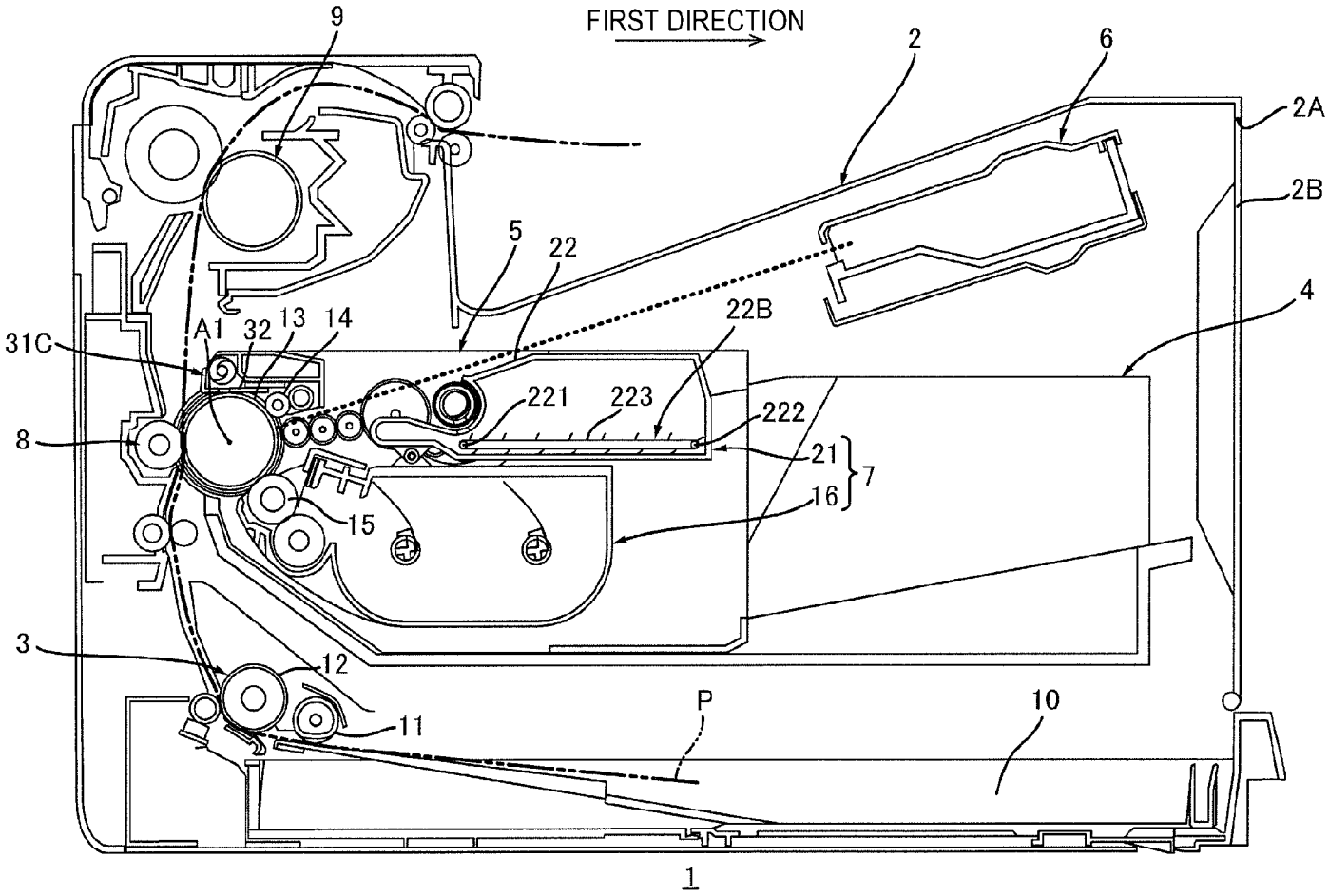
FIG. 1 is a schematic configuration view of an image forming apparatus according to an exemplary embodiment of the present invention.
Figure 2:
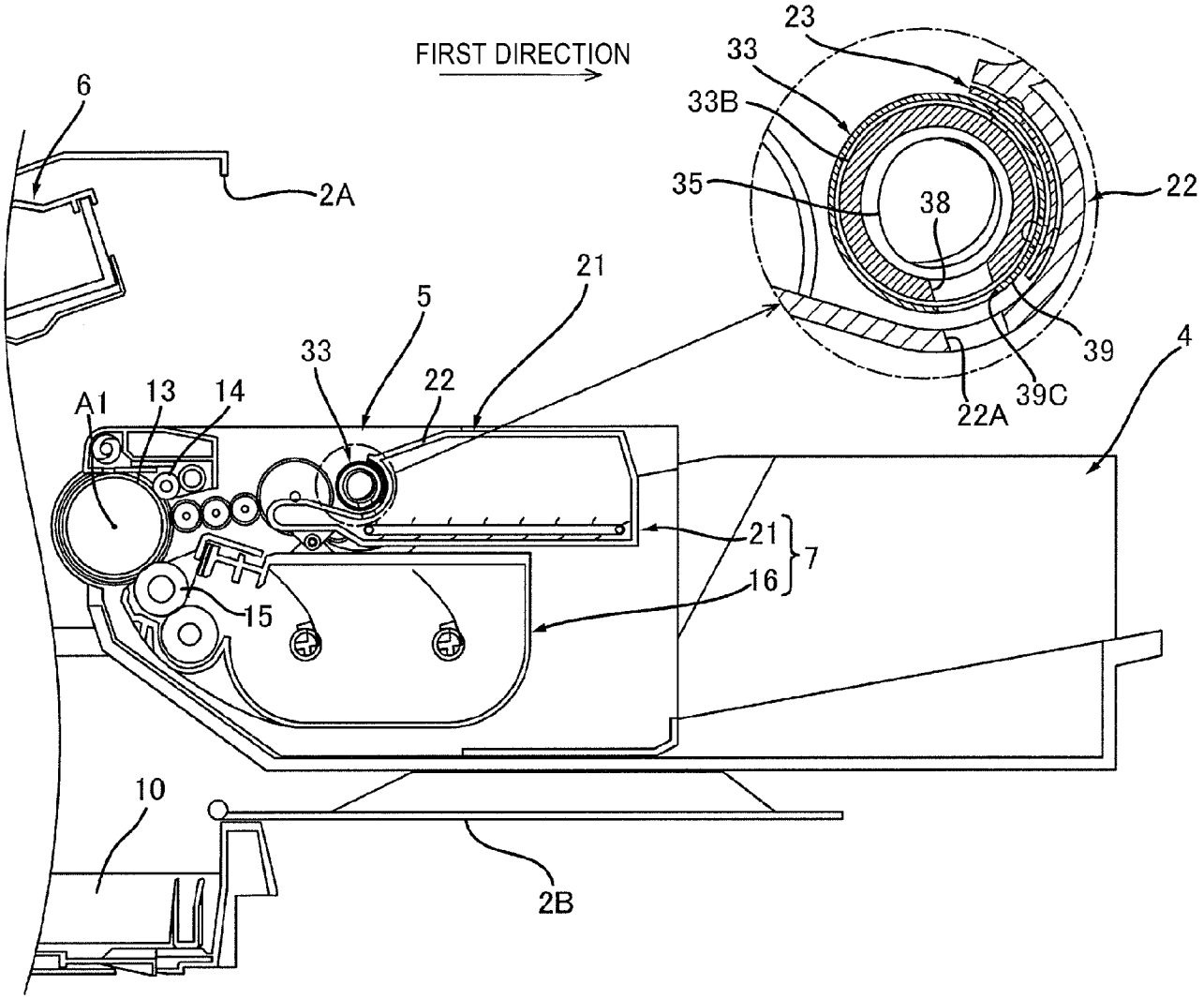
FIG. 2 depicts a state where a drawer shown in FIG. 1 is located at an outer position.

Referring to FIGS. 1 and 2, an outline of an image forming apparatus 1 is described.

As shown in FIG. 1, the image forming apparatus 1 includes an apparatus main body 2, a feeder unit 3, a drawer 4, a drum cartridge 5, an exposure device 6, a developing cartridge 7, a transfer roller 8, and a fixing device 9.

1.1 Apparatus Main Body

The apparatus main body 2 is configured to accommodate therein the feeder unit 3, the drawer 4, the drum cartridge 5, the exposure device 6, the developing cartridge 7, the transfer roller 8, and the fixing device 9. The apparatus main body 2 has an opening 2A and a cover 2B.

The opening 2A is located at an opposite side to the transfer roller 8 with respect to the drum cartridge 5 in a state where the drum cartridge 5 is mounted to the apparatus main body 2.

The cover 2B is configured to be moveable between a closing position (see FIG. 1) at which the opening 2A is closed and an opening position (see FIG. 2) at which the opening 2A is opened.

1.2 Feeder Unit

The feeder unit 3 is configured to feed a printing medium P to a photosensitive drum 13. The printing medium P is, for example, a printing sheet. The photosensitive drum 13 will be described later. The feeder unit 3 includes a sheet feeding tray 10, a pickup roller 11, and a sheet feeding roller 12. The sheet feeding tray 10 is configured to accommodate therein the printing medium P. The pickup roller 11 is configured to convey the printing medium P in the sheet feeding tray 10 toward the sheet feeding roller 12. The sheet feeding roller 12 is configured to covey the printing medium P conveyed from the pickup roller 11 toward the photosensitive drum 13.

1.3 Drawer

The drawer 4 is configured to be moveable between an inner position (see FIG. 1) and an outer position (see FIG. 2) in a state where the cover 2B is located at the opening position. When the drawer 4 is located at the inner position, the drawer 4 is located inside the apparatus main body 2. When the drawer 4 is located at the outer position, the drawer 4 is located outside the apparatus main body 2. The drawer 4 is configured to support the drum cartridge 5. The drawer 4 is configured to be moveable while supporting the drum cartridge 5 between the inner position and the outer position. When the drawer 4 comes into contact with a part of the apparatus main body 2, it is stopped at the outer position.

Figure 3:
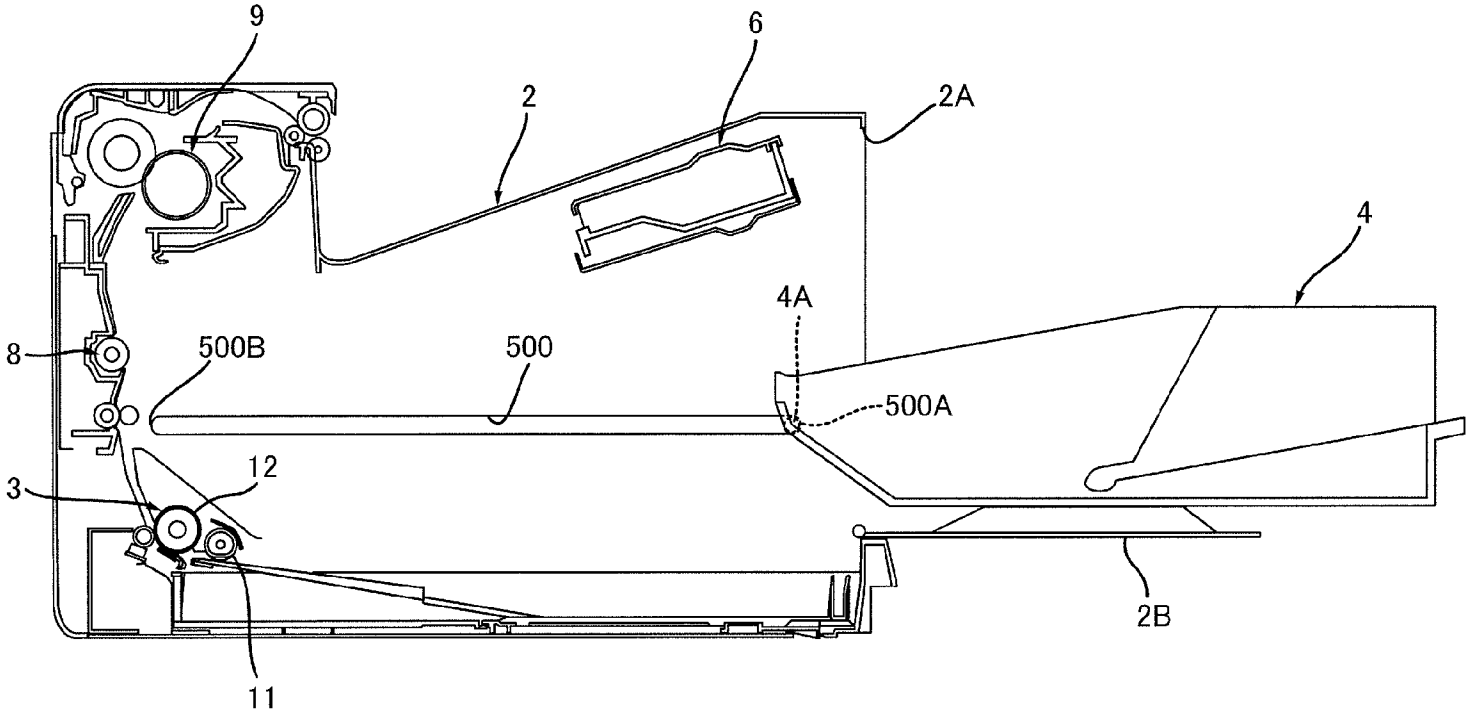
FIG. 3 illustrates a guide groove for guiding movement of the drawer shown in FIG. 2.

Specifically, as shown in FIG. 3, the apparatus main body 2 has a guide groove 500. The guide groove 500 extends in a moving direction of the drawer 4. The guide groove 500 has one end 500A and another end 500B in the moving direction of the drawer 4. The other end 500B is distant from the one end 500A in the moving direction of the drawer 4. Also, the drawer 4 has a projection 4A. The projection 4A is located at a side surface of the drawer 4 in an axis direction, which is a direction in which a rotary axis A1 of the photosensitive drum 13 extends. The projection 4A is fitted in the guide groove 500. Thereby, the drawer 4 can move along the guide groove 500. That is, the guide groove 500 is configured to guide movement of the drawer 4. When the drawer 4 is moved from the outer position toward the inner position, the photosensitive drum 13 comes into contact with the transfer roller 8 and is thus stopped at the inner position. Also, when the drawer 4 is moved from the inner position toward the outer position, the projection 4A comes into contact with an inner surface of the one end 500A of the guide groove 500, i.e., a part of the apparatus main body 2 and is thus stopped at the outer position.

Figure 4:
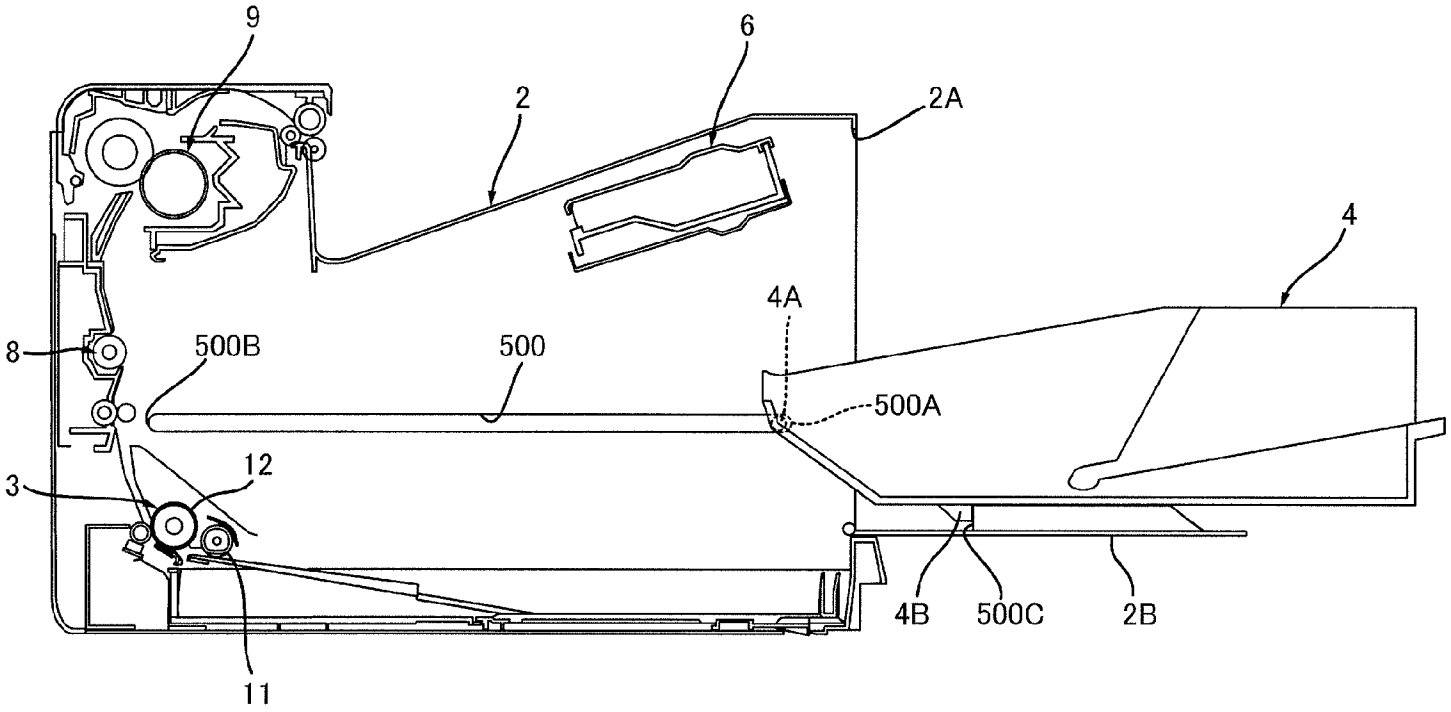
FIG. 4 illustrates a modified embodiment configured to stop the drawer at the outer position.

Here, as shown in FIG. 4, the part of the apparatus main body 2 may be the cover 2B. Specifically, the cover 2B has a stopper 500C, and the drawer 4 has a projection 4B. When the drawer 4 is moved from the inner position toward the outer position, the projection 4B comes into contact with the stopper 500C and is thus stopped at the outer position.

1.4 Drum Cartridge

The drum cartridge 5 is mountable to the drawer 4. The drum cartridge 5 includes a photosensitive drum 13 and a charging roller 14.

The photosensitive drum 13 is configured to be rotatable about the rotary axis A1 extending in the axis direction. The photosensitive drum 13 extends in the axis direction, and has a cylindrical shape.

The charging roller 14 is configured to charge a peripheral surface of the photosensitive drum 13. The charging roller 14 is in contact with the peripheral surface of the photosensitive drum 13. In the meantime, the drum cartridge 5 may include a non-contact type charger such as a scorotron-type charger, instead of the charging roller 14.

1.5 Exposure Device

The exposure device 6 is configured to expose the photosensitive drum 13 to form a latent image on a peripheral surface of the photosensitive drum 13. Specifically, the exposure device 6 is configured to expose the peripheral surface of the photosensitive drum 13 charged by the charging roller 14. Thereby, a latent image is formed on the peripheral surface of the photosensitive drum 13. The exposure device 6 is located above the drawer 4. Specifically, the exposure device 6 is a laser scan unit.

1.6 Developing Cartridge

The developing cartridge 7 is attachable to and detachable from the drum cartridge 5. The developing cartridge 7 includes a toner container 16.

The toner container 16 includes a developing roller 15. The toner container 16 is capable of accommodating therein toner that is to be supplied to the developing roller 15.

The developing roller 15 is in contact with the photosensitive drum 13 in a state where the developing cartridge 7 is attached to the drum cartridge 5. The developing roller 15 can supply the toner in the developing cartridge 7 to the photosensitive drum 13 in the state where the developing cartridge 7 is attached to the drum cartridge 5. Thereby, the developing roller 15 is configured to develop the latent image formed on the photosensitive drum 13 by the toner, thereby forming a toner image on the peripheral surface of the photosensitive drum 13.

1.7 Transfer Roller

The transfer roller 8 is in contact with the photosensitive drum 13 in a state where the drum cartridge 5 is mounted to the drawer 4 and the drawer 4 is located at the inner position. The printing medium P fed from the sheet feeding tray 10 passes between the transfer roller 8 and the photosensitive drum 13. At this time, the transfer roller 8 is configured to transfer the toner image formed on the peripheral surface of the photosensitive drum 13 to the printing medium P.

1.8 Fixing Device

The fixing device 9 is configured to heat and press the printing medium P having the toner image transferred thereto, thereby fixing the toner image, which has been transferred from the photosensitive drum 13 to the printing medium P, on the printing medium P. The printing medium P having passed through the fixing device 9 is discharged onto an upper surface of the apparatus main body 2. The fixing device 9 is spaced upward from the photosensitive drum 13 in the state where the drum cartridge 5 is mounted to the drawer 4 and the drawer 4 is located at the inner position. That is, the image forming apparatus 1 is equipped on a horizontal stand or the like so that the fixing device 9 is located above the photosensitive drum 13.

2. Details of Developing Cartridge

Subsequently, the developing cartridge 7 is described in detail with reference to FIGS. 5 and 6.

Figure 5:
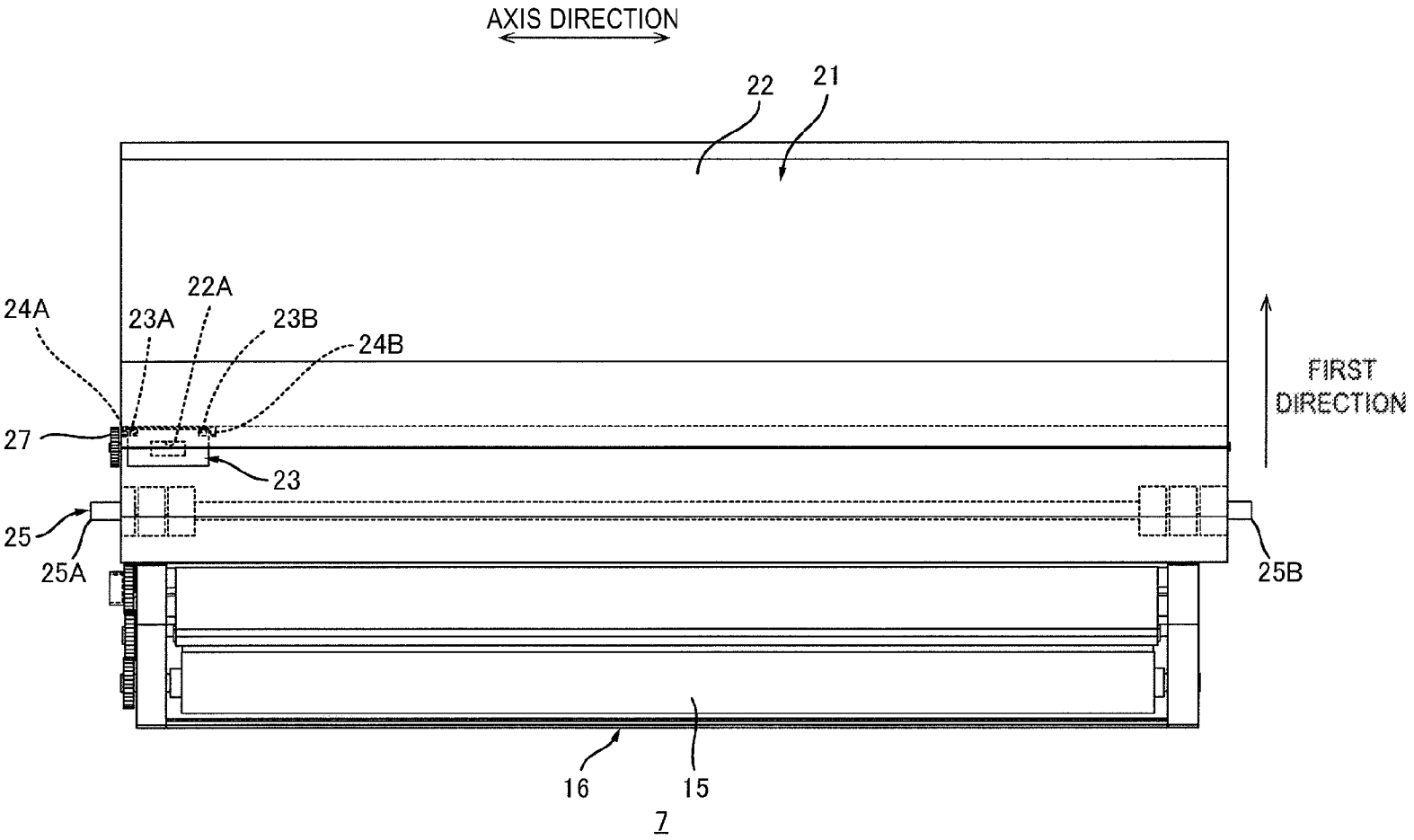
FIG. 5 is a plan view of a developing cartridge shown in FIG. 1.
Figure 6:
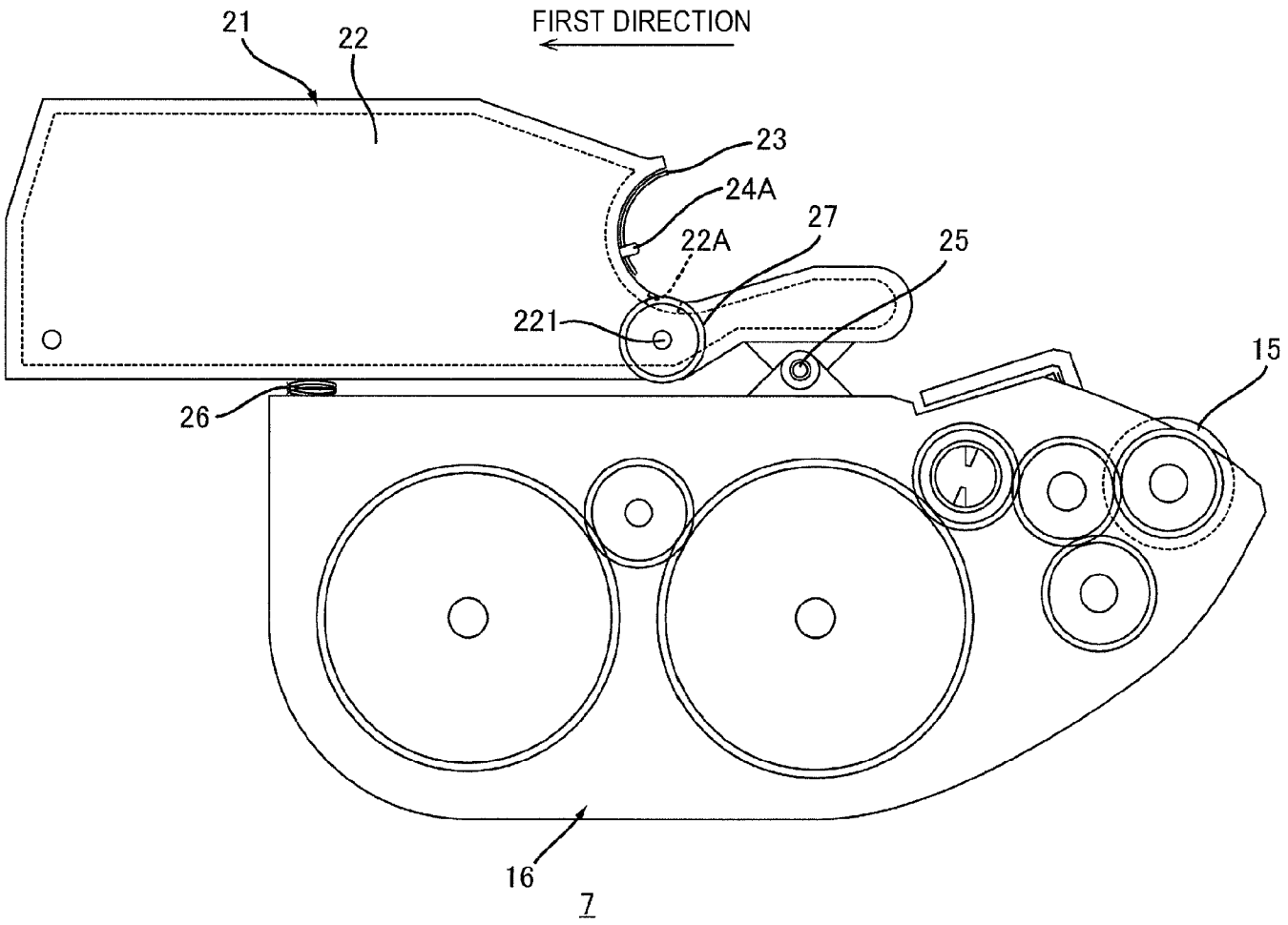
FIG. 6 is a side view of the developing cartridge shown in FIG. 5.

As shown in FIGS. 5 and 6, the developing cartridge 7 includes the toner container 16 and a waste toner container 21.

2.1 Waste Toner Container

The waste toner container 21 is capable of accommodating therein waste toner. The waste toner indicates toner removed from the peripheral surface of the photosensitive drum 13 by a cleaning member 32. The cleaning member 32 will be described in detail later. Specifically, the waste toner container 21 includes a housing 22, a shutter 23, two projections 24A, 24B (see FIG. 6), a shaft 25, a pressing member 26 (see FIG. 6), and a gear 27.

2.1.1 Housing

The housing 22 extends in the axis direction. The housing 22 has a receiving port 22A and a conveyor member 22B (see FIG. 1).

In the state where the developing cartridge 7 is attached to the drum cartridge 5, the waste toner that is discharged from a discharge port 38 (see FIG. 2) of the waste toner conveying pipe 33 is received through the receiving port 22A. The waste toner conveying pipe 33 will be described later. The waste toner received through the receiving port 22A is accommodated in the housing 22. Thereby, the waste toner container 21 is capable of accommodating therein the waste toner.

As shown in FIG. 1, the conveyor member 22B is provided in the housing 22. The conveyor member 22B is configured to convey the waste toner accommodated in the housing 22 in a first direction. Specifically, the conveyor member 22B is a belt conveyor extending in the first direction. The conveyor member 22B has a shaft 221, a shaft 222, and a belt 223. The shaft 222 is located more distant from the receiving port 22A than the shaft 221. The belt 223 extends over the shaft 221 and the shaft 222.

2.1.2 Shutter

As shown in FIGS. 5 and 6, the shutter 23 is attached to the housing 22. The shutter 23 is configured to be moveable relative to the housing 22 between an opening position (see FIG. 6) at which the shutter 23 opens the receiving port 22A and a closing position (see FIG. 5) at which the shutter 23 closes the receiving port 22A. The shutter 23 extends in the axis direction. The shutter 23 has a plate shape. The shutter 23 is formed with two holes 23A, 23B. The hole 23B is spaced from the hole 23A in the axis direction. The two holes 23A, 23B are through-holes, respectively. In the meantime, the receiving port 22A is located between the hole 23A and the hole 23B in the axis direction. The receiving port 22A is spaced from the hole 23A and the hole 23B in the axis direction. In the state where the developing cartridge 7 is attached to the drum cartridge 5, the projection 40A (see FIG. 7) of the waste toner conveying pipe 33 is fitted in the hole 23A, and the projection 40B (see FIG. 7) of the waste toner conveying pipe 33 is fitted in the hole 23B. Thereby, in the state where the developing cartridge 7 is attached to the drum cartridge 5, the shutter 23 is fixed to the waste toner conveying pipe 33 (see FIG. 7).

2.1.3 Two Projections

The two projections 24A, 24B extend from the housing 22. The projection 24B is spaced from the projection 24A in the axis direction. In the state where the developing cartridge 7 is attached to the drum cartridge 5, the projection 24A is fitted in a notch 39A (see FIG. 7) of a shutter 39 of the waste toner conveying pipe 33, and the projection 24B is fitted in a notch 39B (see FIG. 7) of the shutter 39 of the waste toner conveying pipe 33. Thereby, in the state where the developing cartridge 7 is attached to the drum cartridge 5, the shutter 39 of the waste toner conveying pipe 33 is fixed to the housing 22. In the meantime, since the shutter 23 is located between the projection 24A and the projection 24B, it can be moved relative to the housing 22.

2.1.4 Shaft

The shaft 25 is configured to swingably couple the waste toner container 21 and the toner container 16 each other. The shaft 25 is attached to an outer surface of the housing 22. The shaft 25 is located below the housing 22, in the state where the developing cartridge 7 is attached to the drum cartridge 5. The shaft 25 extends in the axis direction. The shaft 25 has one end 25A and another end 25B in the axis direction. The other end 25B is spaced from the one end 25A in the axis direction. Each of the one end 25A and the other end 25B protrudes axially from the waste toner container 21. Specifically, the one end 25A is located more distant from the other end 25B than the waste toner container 21 in the axis direction. Also, the one end 25A is located more distant from the other end 25B than the toner container 16 in the axis direction. The other end 25B is located at an opposite side to the one end 25A with respect to the waste toner container 21 in the axis direction. The other end 25B is located more distant from the one end 25A than the waste toner container 21 in the axis direction. Also, the other end 25B is located more distant from one end 25A than the toner container 16 in the axis direction. The shaft 25 is configured to swingably support the toner container 16. Thereby, the waste toner container 21 is mountable to the drum cartridge 5 together with the toner container 16.

2.1.5 Pressing Member

As shown in FIG. 6, the pressing member 26 is located between the housing 22 and the developing cartridge 7. In the state where the developing cartridge 7 is attached to the drum cartridge 5, the pressing member 26 is located at an opposite side to the developing roller 15 with respect to the shaft 25 in the first direction. The pressing member 26 is, specifically, a compression coil spring. The pressing member 26 is configured to press the toner container 16 toward a direction in which the developing roller 15 comes into contact with the photosensitive drum 13 in the state where the developing cartridge 7 is attached to the drum cartridge 5.

2.1.6 Gear

The gear 27 is located on the outer surface of the housing 22 in the axis direction. The gear 27 is attached to the shaft 221 of the conveyor member 22B. The gear 27 is configured to be rotatable together with the shaft 221 of the conveyor member 22B.

2.2 Toner Container

As shown in FIG. 6, the toner container 16 is swingably coupled to the waste toner container 21. Specifically, the toner container 16 is attached to the shaft 25 of the waste toner container 21. The toner container 16 is configured to be rotatable about the shaft 25. Thereby, as shown in FIG. 1, the toner container 16 can be moved relative to the photosensitive drum 13 in the state where the developing cartridge 7 is attached to the drum cartridge 5.

3. Details of Drum Cartridge

Subsequently, the drum cartridge 5 is described in detail with reference to FIGS. 7 and 8.

Figure 7:
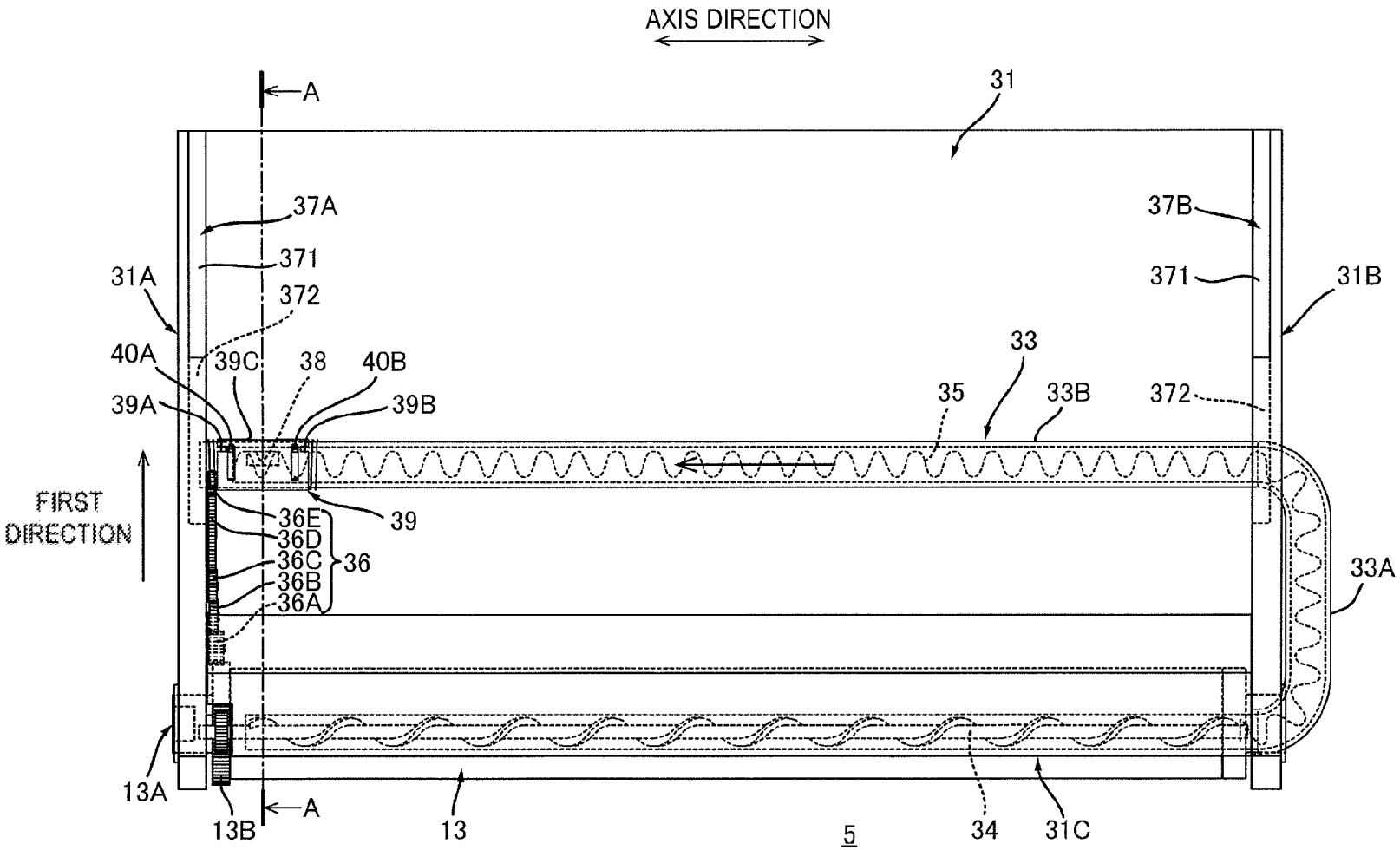
FIG. 7 is a plan view of a drum cartridge shown in FIG. 1.
Figure 8:
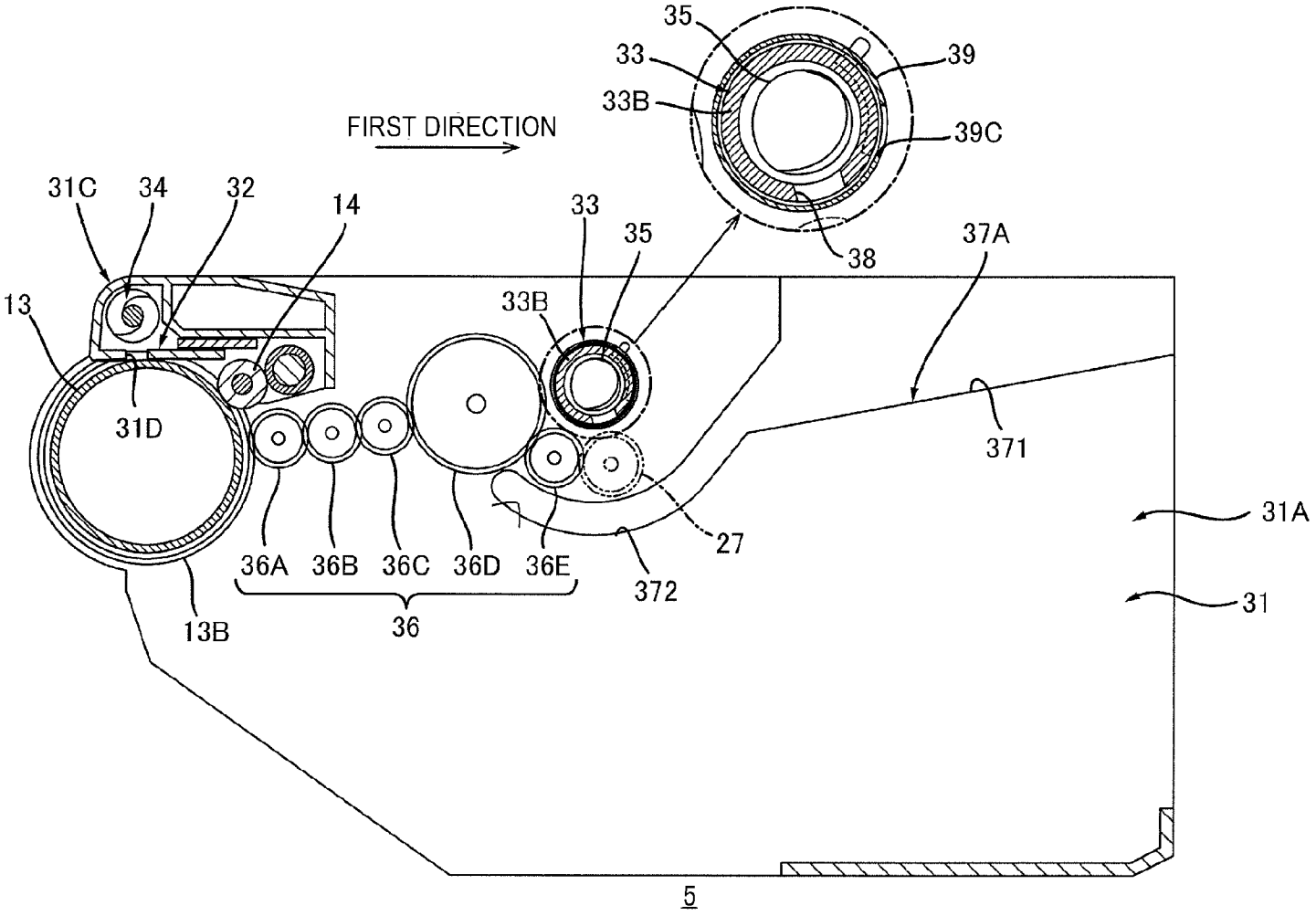
FIG. 8 is a sectional view taken along a line A-A of the drum cartridge shown in FIG. 7.

As shown in FIGS. 7 and 8, the drum cartridge 5 has a drum frame 31, the cleaning member 32 (see FIG. 8), the waste toner conveying pipe 33, a first screw 34, a second screw 35, and a gear train 36.

3.1 Drum Frame

The drum frame 31 is configured to support the photosensitive drum 13, the charging roller 14, the cleaning member 32, the first screw 34 and the waste toner conveying pipe 33. The drum frame 31 has a first side plate 31A, a second side plate 31B, and a waste toner accommodation part 31C (see FIG. 8).

As shown in FIG. 7, the first side plate 31A is located at one end of the drum frame 31 in the axis direction. The first side plate 31A extends in the first direction. The first direction intersects with the axis direction. Preferably, the first direction is perpendicular to the axis direction. The first direction is a direction facing toward a second part 33B of the waste toner conveying pipe 33 from the photosensitive drum 13. The first direction is the same direction as the direction in which the drawer 4 is moved from the inner position toward the outer position in the state where the drum cartridge 5 is mounted to the drawer 4. The first side plate 31A has a guide 37A. That is, the drum cartridge 5 has the guide 37A.

The guide 37A guides the shaft 25 (see FIG. 5) when the developing cartridge 7 is being attached to the drum cartridge 5. Specifically, when the developing cartridge 7 is being attached to the drum cartridge 5, one end 25A of the shaft 25 is fitted in the guide 37A. That is, the guide 37A is configured to guide one end 25A of the shaft 25. As shown in FIG. 8, the guide 37A extends in a pivoting direction of the developing cartridge 7 while passing below the waste toner conveying pipe 33. Specifically, the guide 37A has a first guide part 371 and a second guide part 372.

The first guide part 371 is located at an opposite side to the photosensitive drum 13 with respect to the waste toner conveying pipe 33 in the first direction. The first guide part 371 extends in the first direction.

The second guide part 372 is connected to the first guide part 371. The second guide part 372 is located between the first guide part 371 and the photosensitive drum 13 in the first direction. The second guide part 372 is located around the second part 33B of the waste toner conveying pipe 33. The second guide part 372 is located below the waste toner conveying pipe 33 in the state where the drum cartridge 5 is mounted to the drawer 4. The second guide part 372 extends in a circumferential direction of the second part 33B of the waste toner conveying pipe 33.

As shown in FIG. 7, the second side plate 31B is located at the other end of the drum frame 31 in the axis direction. The second side plate 31B extends in the first direction. The second side plate 31B is spaced from the first side plate 31A in the axis direction. The second side plate 31B has a guide 37B. When the developing cartridge 7 is being attached to the drum cartridge 5, the other end 25B of the shaft 25 is fitted in the guide 37B. That is, the guide 37B is configured to guide the other end 25B of the shaft 25. The guide 37B has the same structure as the guide 37A, so that it can be described in the same manner as the guide 37A. For this reason, the description of the guide 37B is omitted.

As shown in FIG. 8, the waste toner accommodation part 31C is configured to accommodate therein the waste toner removed from the peripheral surface of the photosensitive drum 13 by the cleaning member 32. The waste toner accommodation part 31C is located between the first side plate 31A and the second side plate 31B in the axis direction. The waste toner accommodation part 31C extends in the axis direction. In the state where the drum cartridge 5 is mounted to the drawer 4, the waste toner accommodation part 31C is located above the photosensitive drum 13. Also, in the state where the drum cartridge 5 is mounted to the drawer 4 and the drawer 4 is located at the inner position, the waste toner accommodation part 31C is located below the fixing device 9 (see FIG. 1). That is, in the state where the drum cartridge 5 is mounted to the drawer 4 and the drawer 4 is located at the inner position, the cleaning member 32 is located between the photosensitive drum 13 and the fixing device 9 in the vertical direction. In other words, in the state where the drum cartridge 5 is mounted to the drawer 4 and the drawer 4 is located at the inner position, the photosensitive drum 13, the waste toner accommodation part 31C and the fixing device 9 are arranged in order of the photosensitive drum 13, the waste toner accommodation part 31C and the fixing device 9 in a direction from the lower toward the upper. The waste toner accommodation part 31C has an opening 31D for receiving the waste toner. The opening 31D is configured to communicate with an internal space of the waste toner accommodation part 31C.

3.2 Cleaning Member

As shown in FIG. 8, the cleaning member 32 is configured to remove waste toner from the photosensitive drum 13. The cleaning member 32 is attached to the waste toner accommodation part 31C. The cleaning member 32 extends in the axis direction and has a plate shape. An edge of the cleaning member 32 is located in the opening 31D. The edge of the cleaning member 32 is in contact with the peripheral surface of the photosensitive drum 13. Thereby, when the photosensitive drum 13 is rotated, the toner attached to the peripheral surface of the photosensitive drum 13 is scraped by the edge of the cleaning member 32 and is accommodated in the waste toner accommodation part 31C through the opening 31D. In the state where the drum cartridge 5 is mounted to the drawer 4, the cleaning member 32 is located above the photosensitive drum 13. Also, as shown in FIG. 1, in the state where the drum cartridge 5 is mounted to the drawer 4 and the drawer 4 is located at the inner position, the cleaning member 32 is located between the photosensitive drum 13 and the fixing device 9 (see FIG. 1).

3.3 Waste Toner Conveying Pipe

As shown in FIG. 7, the waste toner conveying pipe 33 is configured to convey the waste toner removed from the photosensitive drum 13 by the cleaning member 32. The waste toner conveying pipe 33 has a first part 33A and the second part 33B.

The first part 33A is configured to couple the waste toner accommodation part 31C and the second part 33B with each other. The first part 33A is supported by the second side plate 31B. The first part 33A is located at an opposite side to the first side plate 31A with respect to the second side plate 31B in the axis direction. The first part 33A extends in the first direction.

The second part 33B is located between the first side plate 31A and the second side plate 31B in the axis direction. The second part 33B has a cylindrical shape extending in the axis direction. That is, the waste toner conveying pipe 33 has a cylindrical shape extending in the axis direction. The second part 33B has the discharge port 38, the shutter 39, and the two projections 40A, 40B. That is, the waste toner conveying pipe 33 has the discharge port 38 and the shutter 39.

The waste toner in the waste toner conveying pipe 33 is discharged through the discharge port 38. The discharge port 38 is located between the first side plate 31A and the second side plate 31B in the axis direction. The discharge port 38 is located closer to the first side plate 31A than the second side plate 31B in the axis direction. In other words, a distance between the first side plate 31A and the discharge port 38 in the axis direction is shorter than a distance between the second side plate 31B and the discharge port 38 in the axis direction.

As shown in FIGS. 7 and 8, the shutter 39 is located on a peripheral surface of the waste toner conveying pipe 33. The shutter 39 can be moved, in the pivoting direction of the developing cartridge 7, between the closing position (see FIG. 8) at which the shutter 39 closes the discharge port 38 and the opening position (see FIG. 2) at which the shutter 39 opens the discharge port 38 when attaching the developing cartridge 7 to the drum cartridge 5. The shutter 39 has two notches 39A, 39B (see FIG. 7) and an opening 39C.

The notch 39B is spaced from the notch 39A in the axis direction. In the meantime, the discharge port 38 is located between the notch 39A and the notch 39B in the axis direction. The discharge port 38 is spaced from the notch 39A and the notch 39B in the axis direction. In the state where the waste toner container 21 is mounted to the drum cartridge 5, the projection 24A (see FIG. 5) of the waste toner container 21 is fitted in the notch 39A and the projection 24B (see FIG. 5) of the waste toner container 21 is fitted in the notch 39B. Thereby, in the state where the developing cartridge 7 is attached to the drum cartridge 5, the shutter 39 is fixed to the waste toner container 21. Thereby, when the developing cartridge 7 is being attached to the drum cartridge 5, the shutter 39 can move together with the waste toner container 21.

The opening 39C is located between the notch 39A and the notch 39B in the axis direction. As shown in FIG. 2, when the shutter 39 is located at the opening position, the opening 39C communicates with the discharge port 38. Thereby, the shutter 39 opens the discharge port 38. Also, as shown in FIG. 8, when the shutter 39 is located at the closing position, the opening 39C becomes distant from the discharge port 38 and does not communicate with the discharge port 38. When the shutter 39 is located at the closing position, the shutter 39 covers the discharge port 38. Thereby, the shutter 39 closes the discharge port 38.

As shown in FIG. 7, the two projections 40A, 40B extend from a peripheral surface of the second part 33B of the waste toner conveying pipe 33. The projection 40B is spaced from the projection 40A in the axis direction. In the state where the developing cartridge 7 is attached to the drum cartridge 5, the projection 40A is fitted in the hole 23A (see FIG. 5) of the shutter 23 of the waste toner container 21 and the projection 40B is fitted in the hole 23B (see FIG. 5) of the shutter 23 of the waste toner container 21. Thereby, in the state where the developing cartridge 7 is attached to the drum cartridge 5, the shutter 23 of the waste toner container 21 is fixed to the waste toner conveying pipe 33.

3.4 First Screw

As shown in FIG. 7, the first screw 34 is located in the waste toner accommodation part 31C. The first screw 34 extends in the axis direction. Thereby, the first screw 34 can convey the waste toner in the waste toner accommodation part 31C in the axis direction. The first screw 34 is, specifically, an auger screw.

3.5 Second Screw

As shown in FIG. 7, the second screw 35 is located in the waste toner conveying pipe 33. The second screw 35 extends in the direction in which the waste toner conveying pipe 33 extends. The second screw 35 is configured to convey the waste toner conveyed by the first screw 34 to the discharge port 38. The second screw 35 is, specifically, a shaftless screw.

3.6 Gear Train

As shown in FIG. 8, the gear train 36 is configured to couple the drum gear 13B and the gear 27 of the waste toner container 21 each other in the state where the developing cartridge 7 is attached to the drum cartridge 5.

Specifically, as shown in FIG. 7, the drum cartridge 5 has a drum coupling 13A and a drum gear 13B. The drum coupling 13A and the drum gear 13B are attached to one end portion of the photosensitive drum 13 in the axial direction. In the state where the drum cartridge 5 is mounted to the drawer 4 and the drawer 4 is located at the inner position, the drum coupling 13A is engaged with a main body coupling of the image forming apparatus 1. The main body coupling is not shown. The drum coupling 13A can rotate together with the main body coupling with being engaged with the main body coupling. The drum gear 13B is located between the drum coupling 13A and the photosensitive drum 13. The drum gear 13B can rotate together with the drum coupling 13A and the photosensitive drum 13.

As shown in FIG. 8, the gear train 36 includes a plurality of idle gears 36A, 36B, 36C, 36D, 36E. The idle gear 36A is in mesh with the drum gear 13B. The idle gear 36B is in mesh with the idle gear 36A. The idle gear 36C is in mesh with the idle gear 36B. The idle gear 36D is in mesh with the idle gear 36C. The idle gear 36E is in mesh with the idle gear 36D. In the state where the developing cartridge 7 is attached to the drum cartridge 5, the idle gear 36E is in mesh with the gear 27 of the waste toner container 21. Thereby, power input to the drum coupling 13A (see FIG. 7) by the main body coupling is transmitted to the conveyor member 22B (see FIG. 1) of the waste toner container 21 via the drum gear 13B, the gear train 36 and the gear 27.

4. Attaching of Developing Cartridge to Drum Cartridge

Subsequently, attaching of the developing cartridge 7 to the drum cartridge 5 is described with reference to FIGS. 2 and 9.

Figure 9:
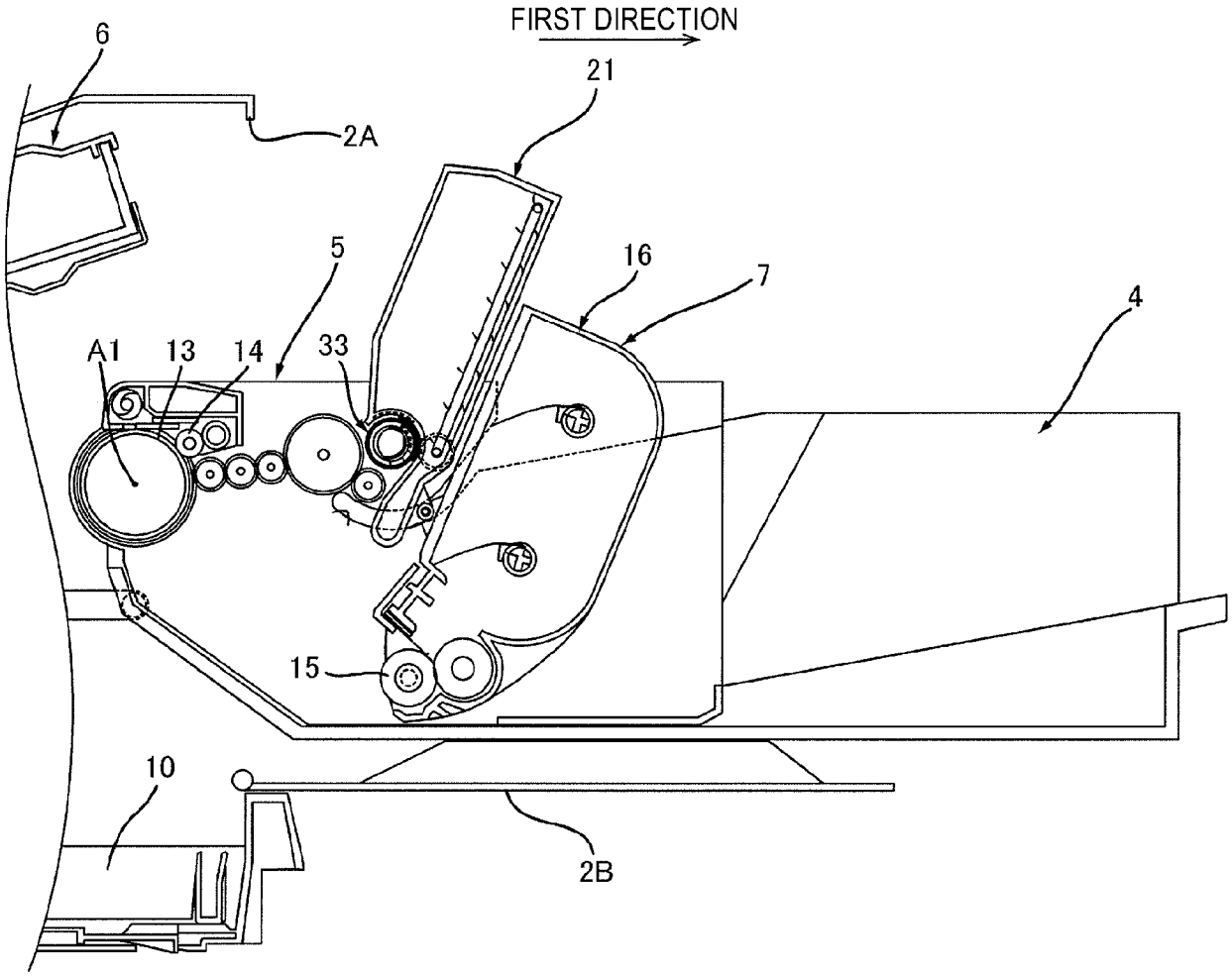
FIG. 9 illustrates a state where the developing cartridge is being attached to the drum cartridge.

As shown in FIGS. 2 and 9, the developing cartridge 7 is attachable to and detachable from the drum cartridge 5 in the state where the drum cartridge 5 is mounted to the drawer 4 and the drawer 4 is located at the outer position. Thereby, it is possible to separate and replace only the developing cartridge 7 from the drum cartridge 5 with the drum cartridge 5 being mounted to the drawer 4 in the state where the drawer 4 is located at the outer position. Also, in the state where the drawer 4 is located at the outer position and the projection 4A of the drawer 4 is in contact with the inner surface of the one end 500A (see FIG. 3) of the guide groove 500, the photosensitive drum 13 is located inside the apparatus main body 2. For this reason, it is possible to suppress situations where the photosensitive drum 13 is irradiated with outside light and is thus deteriorated and foreign matters are attached to the photosensitive drum 13. Also, in the state where the drawer 4 is located at the outer position and the projection 4A of the drawer 4 is in contact with the inner surface of the one end 500A of the guide groove 500, the second part 33B and the discharge port 38 of the waste toner conveying pipe 33 are located outside the apparatus main body 2. For this reason, when attaching the developing cartridge 7 to the drum cartridge 5, it is possible to easily couple the waste toner container 21 of the developing cartridge 7 and the waste toner conveying pipe 33 of the drum cartridge 5 with each other. The developing cartridge 7 is pivoted relative to the waste toner conveying pipe 33 when being attached to the drum cartridge 5.

Specifically, as shown in FIG. 9, when the developing cartridge 7 is being attached to the drum cartridge 5, the waste toner container 21 and the waste toner conveying pipe 33 are first coupled to each other. At this time, the shutter 23 (see FIG. 5) of the waste toner container 21 is fixed to the second part 33B (see FIG. 7) of the waste toner conveying pipe 33 while being located at the closing position, as described above. Also, as described above, the shutter 39 (see FIG. 7) of the waste toner conveying pipe 33 is fixed to the housing 22 (see FIG. 5) of the waste toner container 21 while being located at the closing position.

Then, as shown in FIGS. 2 and 9, the developing cartridge 7 is pivoted relative to the waste toner conveying pipe 33 in the state where the waste toner container 21 and the waste toner conveying pipe 33 are coupled to each other.

At this time, the shutter 23 (see FIG. 5) is fixed to the waste toner conveying pipe 33 and is thus not moved relative to the waste toner conveying pipe 33. In this state, the waste toner container 21 is pivoted relative to the waste toner conveying pipe 33, so that the housing 22 of the waste toner container 21 is moved relative to the shutter 23. Thereby, the shutter 23 is moved relative to the housing 22 of the waste toner container 21 from the closing position to the opening position.

Also, the shutter 39 (see FIG. 2) is fixed to the housing 22 of the waste toner container 21, and is thus pivoted relative to the waste toner conveying pipe 33 together with the housing 22. Thereby, the shutter 23 is moved relative to the waste toner conveying pipe 33 from the closing position to the opening position. That is, when the developing cartridge 7 is being attached to the drum cartridge 5, the projection 24A is fitted in the notch 39A and the projection 24B is fitted in the notch 39B, so that the shutter 39 can be moved in the pivoting direction of the developing cartridge 7 between the closing position and the opening position.

Thereby, as shown in FIG. 2, in the state where the developing cartridge 7 is attached to the drum cartridge 5, the shutter 23 and the shutter 39 are respectively located at the opening position.

In the meantime, the developing cartridge 7 is mountable to the drawer 4 together with the drum cartridge 5 in the state where the drawer 4 is located at the outer position.

5. Operational Effects

As shown in FIG. 9, in the image forming apparatus 1, the drum cartridge 5 is mountable to the drawer 4 and the developing cartridge 7 is attachable to and detachable from the drum cartridge 5.

For this reason, in the image forming apparatus 1 where the cleaning member 32 is located between the photosensitive drum 13 and the fixing device 9 in the state where the drum cartridge 5 is mounted to the drawer 4 and the drawer 4 is located at the inner position, it is possible to individually replace the drum cartridge 5 and the developing cartridge 7.

Thereby, it is possible to replace each of the drum cartridge 5 and the developing cartridge 7 at an appropriate time, in accordance with each lifetime.

Also, in the image forming apparatus 1, it is possible to convey the waste toner removed by the cleaning member 32 to the waste toner container 21 (see FIG. 1) through the waste toner conveying pipe 33 (see FIG. 7), and to replace the waste toner container 21, together with the toner container 16, as shown in FIG. 9.

Also, as shown in FIG. 1, in the image forming apparatus 1, the toner container 16 is swingably coupled to the waste toner container 21, thereby being capable of moving relative to the photosensitive drum 13 in the state where the developing cartridge 7 is attached to the drum cartridge 5.

Thereby, in the state where the waste toner container 21 is fixed to the drum cartridge 5, the toner container 16 can be moved relative to the photosensitive drum 13 in accordance with vibrations of the developing roller 15, which are generated when the photosensitive drum 13 and the developing roller 15 are rotated.

6. Modified Embodiment

Subsequently, a modified embodiment is described with reference to FIGS. 10 to 12. In the modified embodiment, the same members as the exemplary embodiment are denoted with the same reference numerals, and the descriptions thereof are omitted.

6.1 Drum Cartridge

The drum cartridge 5 of the modified embodiment is described with reference to FIGS. 10 to 12.

Figure 10:
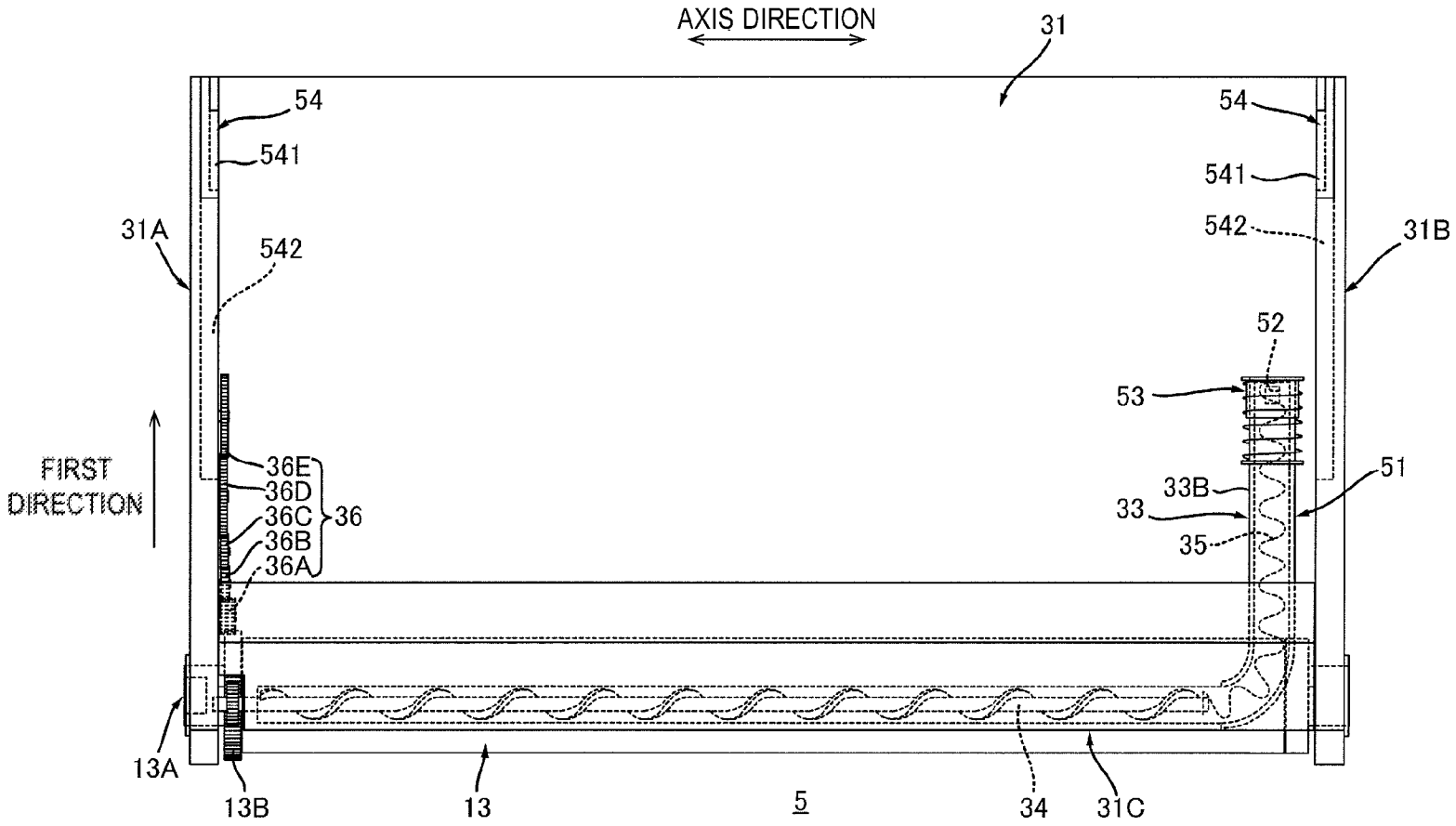
FIG. 10 is a plan view depicting a drum cartridge in a modified embodiment.
Figure 11:
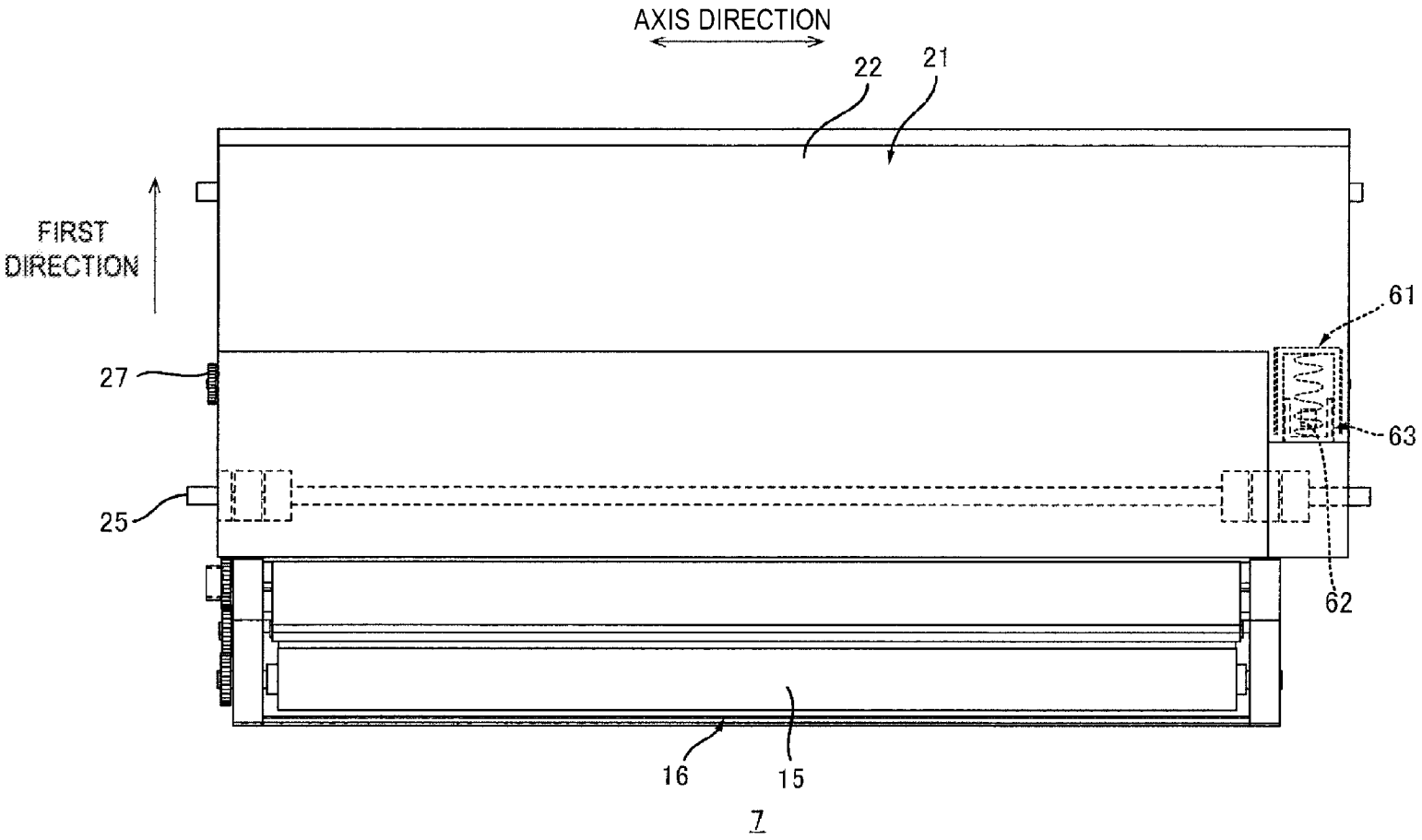
FIG. 11 is a plan view depicting a developing cartridge in the modified embodiment.

As shown in FIG. 10, a waste toner conveying pipe 51 is located between the first side plate 31A and the second side plate 31B in the axis direction. The waste toner conveying pipe 51 has a cylindrical shape extending in the first direction. The waste toner conveying pipe 51 is located closer to the second side plate 31B than the first side plate 31A in the axis direction. That is, a discharge port 52 is located closer to the second side plate 31B than the first side plate 31A in the axis direction.

A shutter 53 is configured to be moveable in the first direction between an opening position (see FIG. 12) at which the shutter 53 opens the discharge port 52 and a closing position (see FIG. 10) at which the shutter 53 closes the discharge port 52. That is, the shutter 53 can be moved between the opening position and the closing position in the direction in which the waste toner conveying pipe 51 extends. When the developing cartridge 7 is being attached to the drum cartridge 5, the shutter 53 comes into contact with the waste toner container 21 and is thus moved from the closing position to the opening position, as shown in FIG. 12.

Figure 12:
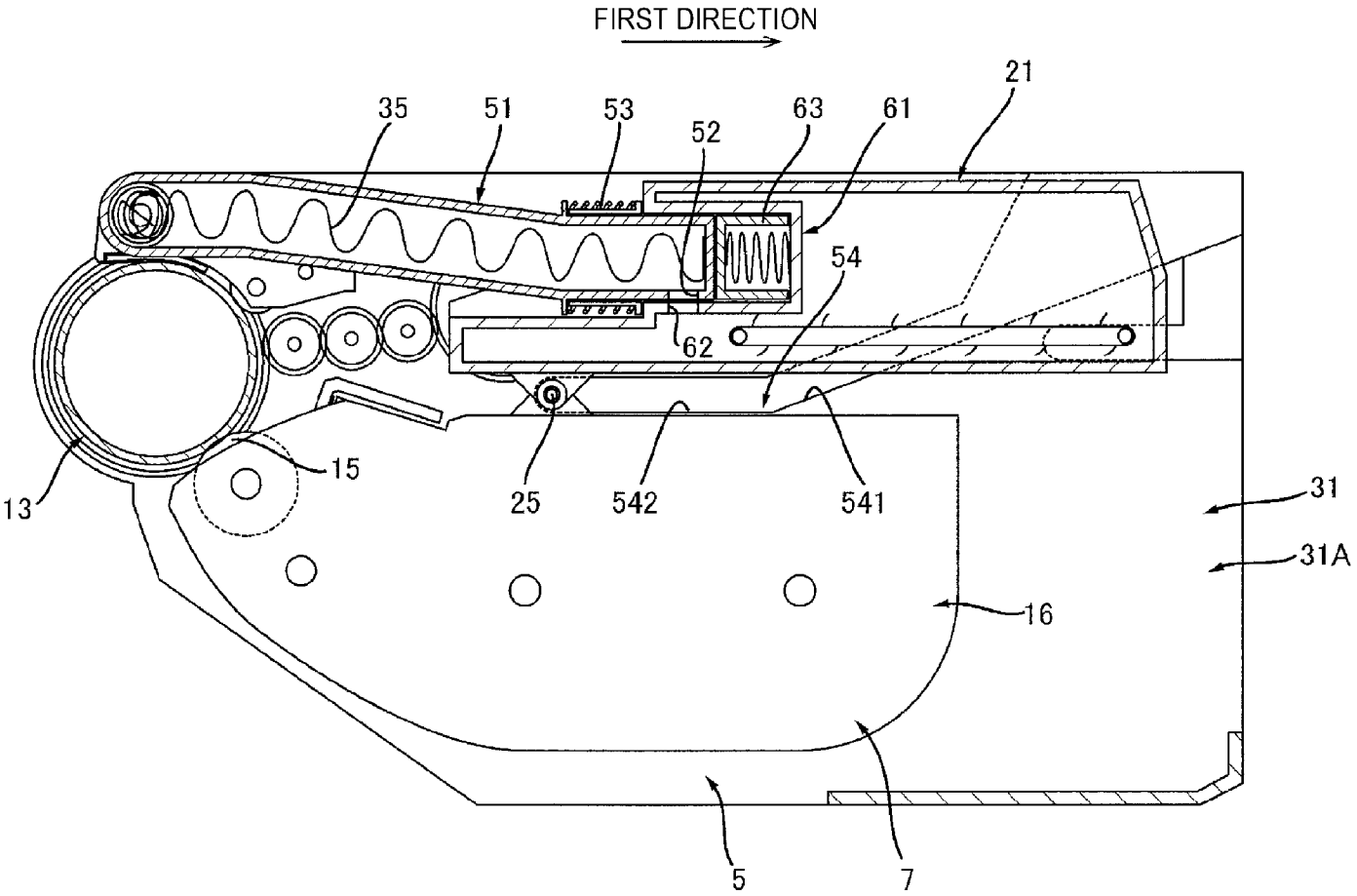
FIG. 12 illustrates a state where the developing cartridge shown in FIG. 11 is being attached to the drum cartridge shown in FIG. 10.

Also, as shown in FIG. 12, a guide 54 has a linear shape extending in the direction in which the waste toner conveying pipe 51 extends, while passing below the waste toner conveying pipe 51. Specifically, the guide 54 has a first guide part 541 and a second guide part 542. The first guide part 541 has the same structure as the first guide part 371 of the guide 37 of the exemplary embodiment, and can be described in the same manner as the first guide part 371 of the guide 37. For this reason, the description of the first guide part 541 is omitted. The second guide part 542 is located below the waste toner conveying pipe 51. The second guide part 542 extends in the first direction. That is, the second guide part 542 extends in the direction in which the waste toner conveying pipe 51 extends.

6.2 Waste Toner Container

Subsequently, the waste toner container 21 of the modified embodiment is described with reference to FIGS. 11 and 12.

The waste toner container 21 has an insertion part 61 in which the waste toner conveying pipe 51 is inserted. The insertion part 61 has a cylindrical shape extending in the first direction. The insertion part 61 has a receiving port 62 and a shutter 63.

The receiving port 62 is located inside the insertion part 61. The receiving port 62 is configured to communicate with an internal space of the waste toner container 21.

The shutter 63 is located inside the insertion part 61. The shutter 63 is configured to be moveable in the first direction between an opening position (see FIG. 12) at which the receiving port 62 is opened and a closing position (see FIG. 11) at which the receiving port 62 is closed. When the waste toner conveying pipe 51 is being inserted in the insertion part 61, the shutter 63 comes into contact with the waste toner conveying pipe 51 and is thus moved from the closing position to the opening position.

6.3 Operational Effects of Modified Embodiment

Also in the modified embodiment, it is possible to accomplish the same operational effects as the exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:
an apparatus main body;
a drum cartridge mountable to the apparatus main body and including
a photosensitive drum; and
a cleaning member configured to remove a waste toner from the photosensitive drum;
an exposure device configured to expose the photosensitive drum;
a developing cartridge attachable to and detachable from the drum cartridge and including:
a developing roller;
a toner container capable of accommodating therein toner to be supplied to the developing roller, the toner container including a top surface; and
a waste toner container capable of accommodating therein the waste toner, the waste toner container being located entirely above the top surface of the toner container when the developing cartridge is attached to the drum cartridge which is attached to the apparatus main body; and
a fixing device spaced upward from the photosensitive drum,
wherein the cleaning member is located between the photosensitive drum and the fixing device in a vertical direction when the developing cartridge is attached to the drum cartridge which is attached to the apparatus main body.

2. The image forming apparatus according to claim 1,
wherein the toner container is coupled to the waste toner container, and thereby the toner container is movable relative to the photosensitive drum when the developing cartridge is attached to the drum cartridge.

3. The image forming apparatus according to claim 2,
wherein the toner container is swingably coupled to the waste toner container.

4. The image forming apparatus according to claim 3,
wherein the waste toner container includes a shaft swingably supporting the toner container, and
wherein the drum cartridge includes a guide configured to guide the shaft when the developing cartridge is being attached to the drum cartridge, the guide extending in a pivoting direction of the developing cartridge.

5. The image forming apparatus according to claim 1, further comprising a waste toner conveying pipe configured to convey the waste toner removed from the photosensitive drum.

6. The image forming apparatus according to claim 5,
wherein the waste toner conveying pipe includes:
a discharge port through which the waste toner is configured to be discharged; and
a discharge shutter configured to be moveable between a closing position at which the discharge shutter closes the discharge port and an opening position at which the discharge shutter opens the discharge port.

7. The image forming apparatus according to claim 6,
wherein the discharge shutter comes into contact with the waste toner container and moves from the closing position to the opening position, when the developing cartridge is being attached to the drum cartridge.

8. The image forming apparatus according to claim 6,
wherein the waste toner container includes:
a receiving port through which the waste toner is configured to be received; and
a receiving shutter configured to be moveable between a closing position at which the receiving shutter closes the receiving port and an opening position at which the receiving shutter opens the receiving port.

9. The image forming apparatus according to claim 1, further comprising a drawer moveable between an inner position located inside the apparatus main body and an outer position located outside the apparatus main body,
wherein the drum cartridge is mountable to the drawer.

10. The image forming apparatus according to claim 9,
wherein the exposure device is located above the drum cartridge and the developing cartridge when the drum cartridge and developing cartridge are mounted to the drawer which is located at the inner position.

11. The image forming apparatus according to claim 10,
wherein the exposure device is located such that the exposure device does not overlap with the drum cartridge and the developing cartridge when viewed in a vertical direction when the drum cartridge and the developing cartridge are mounted to the drawer which is located at the inner position.

12. The image forming apparatus according to claim 10,
wherein the exposure device is located such that the exposure device does not overlap with the waste toner container when viewed in a vertical direction when the drum cartridge and the developing cartridge are mounted to the drawer which is located at the inner position.

13. The image forming apparatus according to claim 1,
wherein the waste toner container includes a pressing member configured to press the toner container toward a direction in which the developing roller comes into contact with the photosensitive drum when the developing cartridge is attached to the drum cartridge.

14. The image forming apparatus according to claim 1,
wherein the apparatus main body further includes a cover configured to be movable between a closing position at which an opening of the apparatus main body is closed by the cover and an opening position at which the opening is opened, wherein a portion of the photosensitive drum is in contact with a transfer roller when the drum cartridge is attached to the apparatus main body, and wherein a first distance in a horizontal direction between the portion of the photosensitive drum in contact with the transfer roller and the cover at the closing position is shorter than a second distance in the horizontal direction between a rear end of the drum cartridge and the cover at the closing position when the drum cartridge is attached to the apparatus main body.

15. The image forming apparatus according to claim 1, wherein the drum cartridge further includes a waste toner conveying pipe configured to convey the waste toner removed from the photosensitive drum by the cleaning member to the waste toner container, wherein the cleaning member is located between the photosensitive drum and the fixing device in a vertical direction in a state where the drum cartridge is mounted to a drawer and the drawer is located at an inner position located inside the apparatus main body, wherein the waste toner conveying pipe includes:

a discharge port through which the waste toner is configured to be discharged; and a first shutter configured to be moveable between a first closing position at which the first shutter closes the discharge port and a first opening position at which the first shutter opens the discharge port, and wherein the waste toner container includes:

a receiving port through which the waste toner is configured to be received; and a second shutter configured to be moveable between a second closing position at which the second shutter closes the receiving port and a second opening position at which the second shutter opens the receiving port.

* * * * *